United States Patent [19]

Mishima

[11] Patent Number: 4,487,098

[45] Date of Patent: Dec. 11, 1984

[54] RHYTHM GENERATOR

[75] Inventor: Toshio Mishima, Kitamoto, Japan

[73] Assignees: Kabushiki Kaisha Kawai Gakki Seisakusho; Tokyo Shibaura Denki K.K., both of Japan

[21] Appl. No.: 510,231

[22] Filed: Aug. 12, 1983

Related U.S. Application Data

[63] Continuation of Ser. No. 292,911, Aug. 14, 1981, abandoned.

[30] Foreign Application Priority Data

Aug. 30, 1980 [JP] Japan ..... 55-119929
Aug. 30, 1980 [JP] Japan ..... 55-119930

[51] Int. Cl.[3] ..... G10H 1/057; G10H 1/40

[52] U.S. Cl. ..... 84/1.03; 84/1.22; 84/1.26; 84/DIG. 12

[58] Field of Search ..... 84/1.01, 1.03, 1.11–1.13, 84/1.19–1.27, DIG. 12

[56] References Cited

U.S. PATENT DOCUMENTS 3,913,442 10/1975 Deutsch ..... 84/1.19
4,000,675 1/1977 Futamase et al. ..... 84/1.01
4,036,096 7/1977 Tomisawa et al. ..... 84/1.01
4,119,005 10/1978 Kondo et al. ..... 84/1.01
4,200,021 4/1980 Chibana ..... 84/1.22
4,223,583 9/1980 Deutsch ..... 84/1.01
4,244,257 1/1981 Niimi et al. ..... 84/1.01
4,336,736 6/1982 Mishima ..... 84/1.26

FOREIGN PATENT DOCUMENTS 124195 9/1980 Japan .

*Primary Examiner*—Stanley J. Witkowski
*Attorney, Agent, or Firm*—McGlew and Tuttle

[57] ABSTRACT

Frequency information is stored in a tone coefficient memory and accumulated to obtain address information for reading out a musical sound from a musical waveshape memory by a musical sound generating circuit. Envelope information is stored in an envelope coefficient memory and accumulated to obtain address information for reading out an envelope waveshape from an envelope memory by an envelope generating circuit. An address counter performs address assignment for operating the musical sound generating circuit and the envelope generating circuit on a time-divided basis. The frequency information and the envelope information are respectively accumulated by a common accumulator on the time-divided basis. Further, attack and decay coefficients are stored in the envelope memory by higher and lower order bits of the same address, respectively, and the contents of the higher and lower order bits are selectively read out.

2 Claims, 5 Drawing Figures

SUMMARY OF THE INVENTION

It is an object of the present invention to provide a rhythm generator which has a simple-structured, small-sized envelope coefficient memory for storing envelope information.

Briefly stated, the rhythm generator of the present invention has a musical sound generating circuit for reading out a musical sound from a musical waveshape memory using address information obtained by accumulating frequency information stored in a tone coefficient memory an envelope generating circuit for reading out an envelope waveshape from an envelope memory using address information obtained by accumulating envelope information stored in an envelope coefficient memory and an address counter for performing address assignment so that the musical sound generating circuit and the envelope generating circuit may operate on a time-divided bases. The frequency information and the envelope information are accumulated by a common accumulator on a time-divided basis. Further, means are provided for storing the attack and the decay coefficient in the envelope coefficient memory by higher and lower order bits of the same address, respectively, and for selectively reading out the contents of the higher and the lower order bits.

DESCRIPTION OF THE PREFERRED EMBODIMENTS

Figure 2:
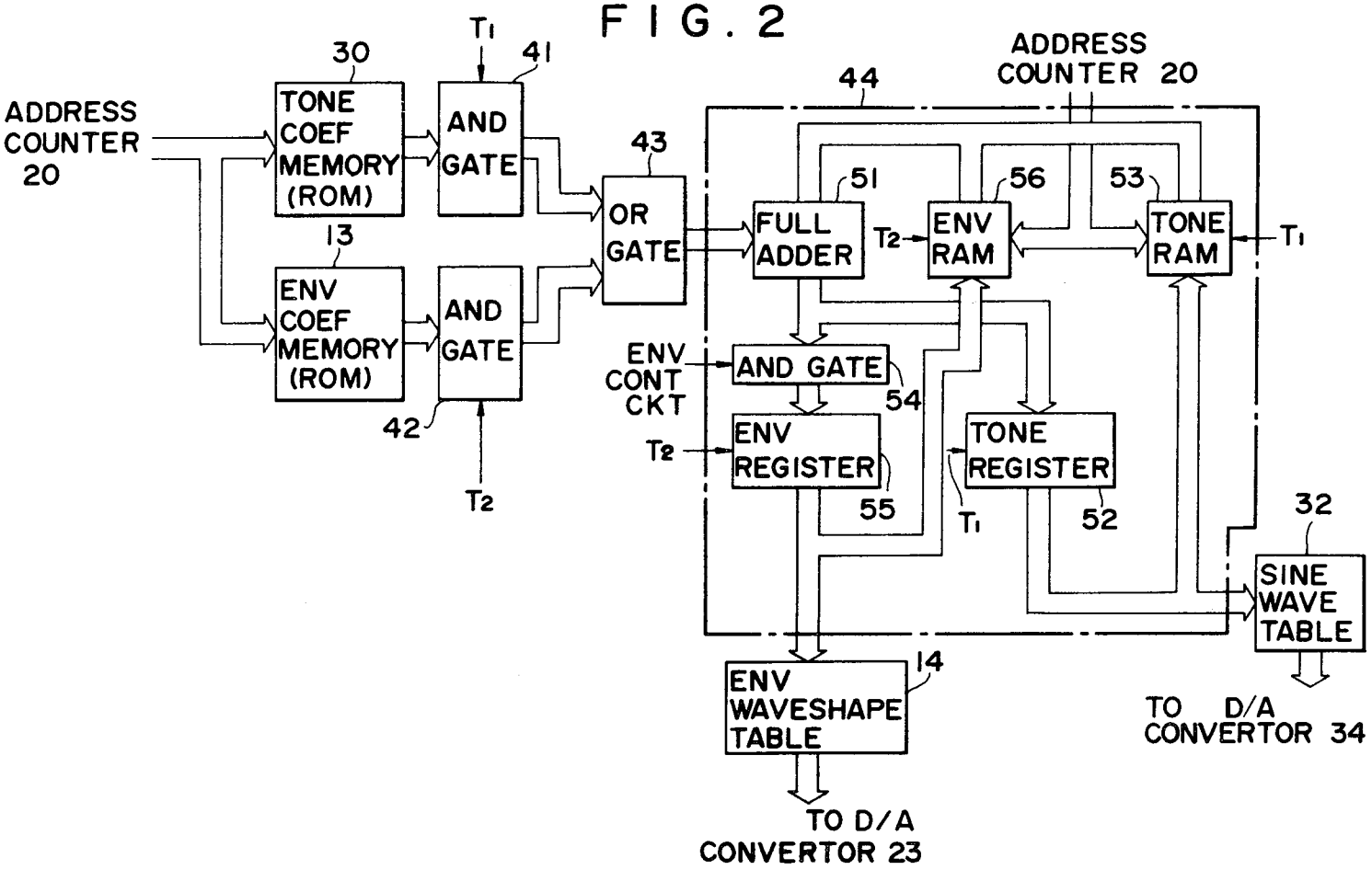
FIG. 2 illustrates the circuit arrangement of an embodiment of the present invention.
Figure 3:
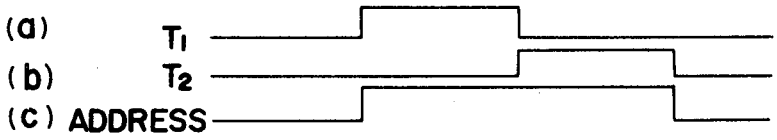
FIG. 3 is a timing chart explanatory of the operation of the embodiment depicted in FIG. 2.

FIG. 2 is an explanatory diagram illustrating the arrangement of an embodiment of the present invention, and FIGS. 3(*a*) to 3(*c*) show operating waveforms occurring at principal parts of the above embodiment.

Figure 1:
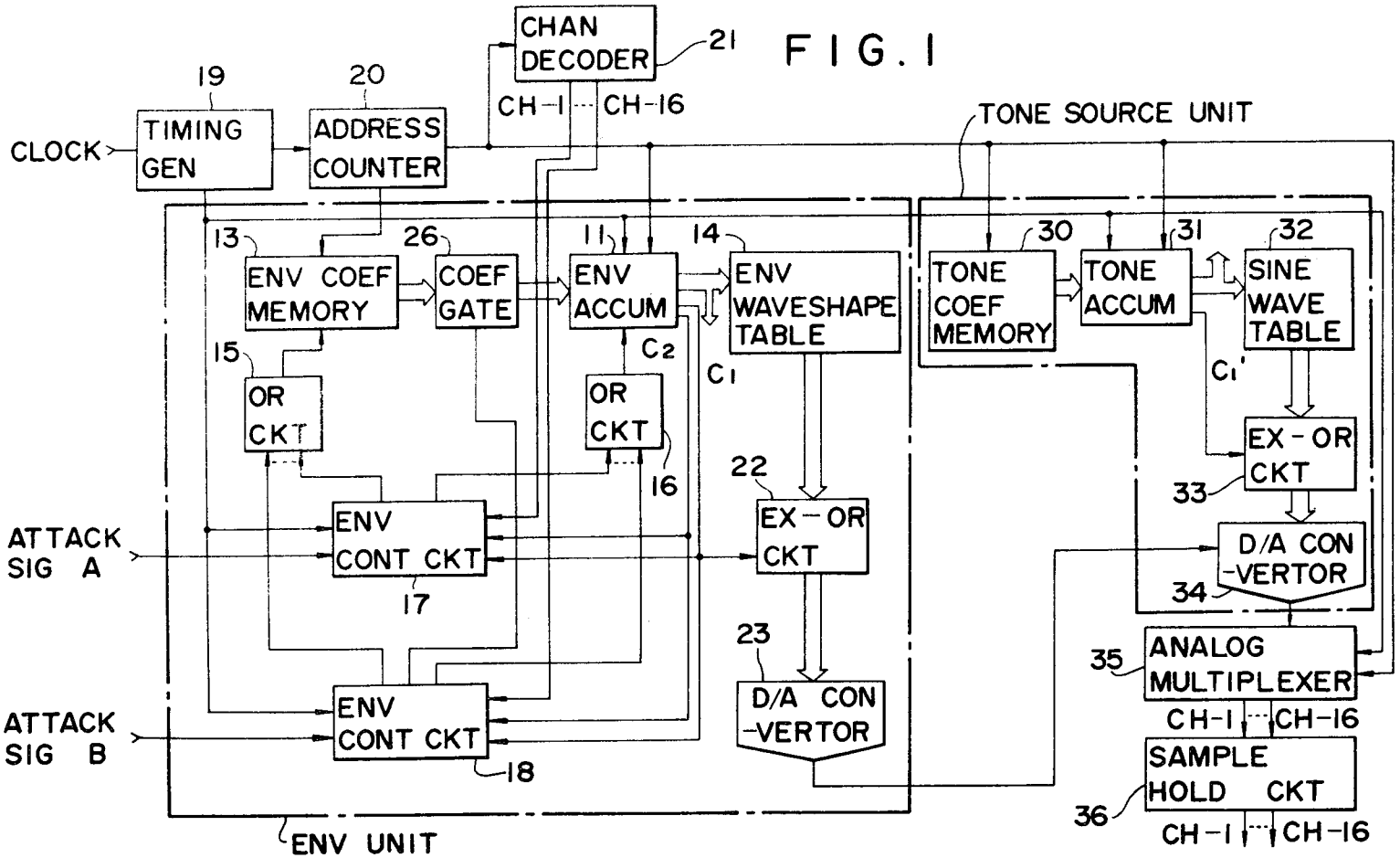
FIG. 1 shows the circuit arrangement of a conventional rhythm generating circuit.

In FIG. 2, the tone coefficient memory (ROM) 30 and the envelope coefficient memory (ROM) 13 are each accessed by use of an address available from the address counter 20 in FIG. 1. From the tone coefficient memory 30 and the envelope coefficient memory 13 are outputted dividing an address period of FIG. 3(*c*) by AND gates 41 and 42 into periods $T_1$ and $T_2$ of FIG. 3(*a*) and 3(*b*) on a time-divided basis, respectively. The outputs are provided via an OR gate 43 to a common accumulator 44 indicated by a one-dot chain line.

The accumulator 44 comprises a loop which is formed, as a tone accumulator, by a full adder 51, a tone register 52 and a tone memory (RAM) 53 and another loop which is formed, as an envelope accumulator, by the full adder 51, and AND gate 54, an envelope register 55 and an envelope memory (RAM) 56.

In the loop of the tone accumulator, the data of the period $T_1$ is applied from the tone coefficient memory 30 to the full adder 51 via the AND gate 41 and the OR gate 43. At the same time, previous data in the tone memory 53 is read out therefrom into the full adder 51 for addition to the data from the tone coefficient memory 30. The added output from the full adder 51 is latched in the tone register 52 and its content is stored in the tone memory 53 and, at the same time, it is provided to the sine wave table 32 to read out therefrom a sine wave of half-wavelength, which is sent to the D-A converter 34 following the procedure described previously in respect of FIG. 1.

In the loop of the envelope accumulator, the data of the period $T_2$ is applied from the envelope coefficient memory 13 to the full adder 51 via the AND gate 42 and the OR gate 43. At the same time, previous data in the envelope memory 56 is read out therefrom into the full adder 51 for addition to the data from the envelope coefficient memory 13. The added output from the full adder 51 is provided to the AND gate 54, wherein it is gated by a control signal from the envelope control circuit referred to previously with regard to FIG. 1 and the output from the AND gate 54 is latched by the envelope register 55. Its content is stored in the envelope memory 56 and, at the same time, it is sent to the envelope waveshape table 14 to read out therefrom an envelope waveshape, which is fed to the D-A converter 23 following the procedure described previously in connection with FIG. 1.

The subsequent steps are identical with those in the case of FIG. 1.

Figure 4:
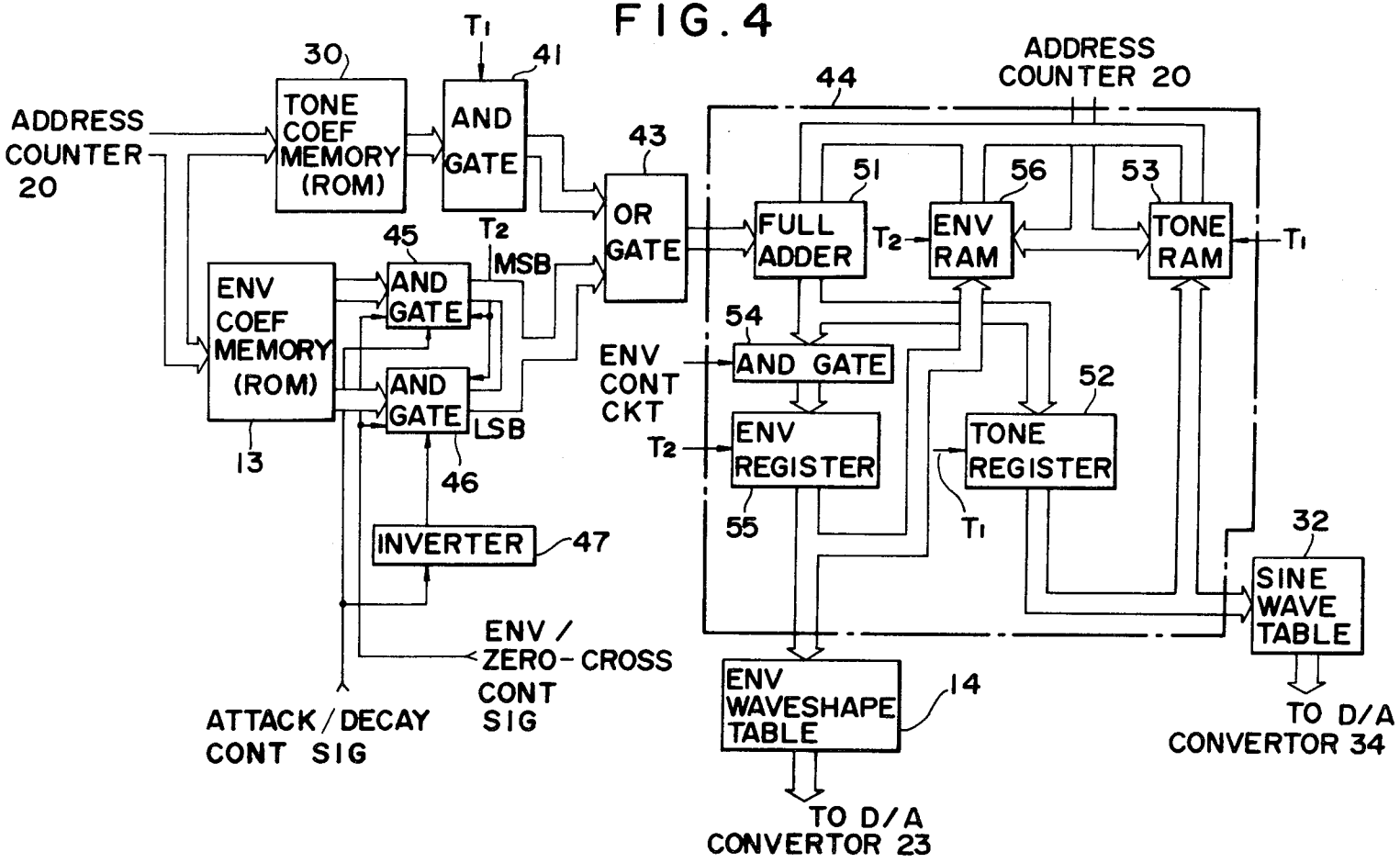
FIG. 4 illustrates the circuit arrangement of another embodiment of the present invention.

FIG. 4 illustrates the circuit arrangement of another embodiment of the present invention.

In FIG. 4, the tone coefficient memory (ROM) 30 and the envelope coefficient memory (ROM) 13 are each accessed by use of an address available from the address counter 20 in FIG. 1. The frequency information from the tone coefficient memory 30 is provided via the AND gate 41 and the OR gate 43 to the common accumulator 44 in synchronism with the period $T_1$.

The envelope coefficient memory 13, which forms the principal part of the present invention, stores the attack and the decay coefficient by the high-order and the low-order bits of one-address data, respectively, as described in detail later. Their outputs read out from the envelope coefficient memory 13 are provided to AND gates 45 and 46, respectively. An attack/decay control signal is applied to the AND gate 46 via a control line having inserted therein an inverter 47, by which the AND gate 46 is changed over so that an output synchronized with the period $T_2$ and an envelope/zero crossing control signal described later is provided via the OR gate 43 to the common accumulator 44. The accumulator 44 comprises a loop which is formed, as a tone accumulator, by a full adder 51, a tone register 52 and a tone memory (RAM) 53 and another loop which is formed, as an envelope accumulator, by the full adder 51, and AND gate 54, an envelope register 55 and an envelope memory (RAM) 56. The content of the envelope coefficient is switched by the attack/decay control signal between the attack and the decay coefficient.

In the loop of the tone accumulator, the data of the period $T_1$ is applied from the tone coefficient memory 30 to the full adder 51 via the AND gate 41 and the OR gate 43. At the same time, previous data in the tone memory 53 is read out therefrom into the full adder 51 for addition to the data from the tone coefficient memory 30. The added output from the full adder 51 is latched in the tone register 52 and its content is stored in the tone memory 53 and, at the same time, it is provided to the sine wave table 32 to read out therefrom a sine wave of half-wavelength, which is sent to the D-A converter 34 following the procedure described previously in respect of FIG. 1.

RHYTHM GENERATOR

This is a continuation of application Ser. No. 06/292,911 filed Aug. 14, 1981, now abandoned.

FIELD AND BACKGROUND OF THE INVENTION

The present invention relates to a rhythm generator which is simplified in construction by reducing the number of envelope coefficient memories for loading envelope information.

Heretofore, there have already been made several proposals for improvement of a rhythm generating circuit of the type employing a tone source summing coefficient and an attack/decay coefficient for generating a plurality of tone sources. This type of rhythm generating circuit comprises a tone source unit for generating a tone source frequency by selection of a rhythm and an envelope unit for imparting an envelope waveshape to the tone source signal. The tone source summing coefficient and the attack/decay coefficient are prestored in memories and various tone source waveshapes or envelope waveshapes are produced by accumulators for the respective coefficients and multiplied in a predetermined combination to generate a desired rhythm note.

FIG. 1 shows the arrangement of a prior example of the rhythm generating circuit. In this case, if the number of tone sources is 16, then 16 channels are needed. The envelope waveshape and the tone source waveshape are formed on a time-divided basis to produce a rhythm note corresponding to a selected rhythm pattern signal. In FIG. 1 a rhythm pattern signal (hereinafter referred to as an attack signal) A is provided to an envelope control circuit 17 to generate timing for attack and decay of the envelope waveshape by signals C1 and C2 described later. A channel specify signal (CH1) from a channel decoder 21, which is specified through an address counter 20 driven by a timing generating circuit 19, is provided to the envelope control circuit 17, from which is applied a specified address signal to an envelope coefficient memory 13 via an OR circuit 15. From the envelope coefficient memory 13 is read out an attack and decay summing coefficient based on an address from the address counter 20 and the summing coefficient thus read out is provided to an accumulator 11 via a coefficient gate 26 controlled to be in the ON state. The accumulator 11 is composed of an adder, a gate circuit, a register and a memory (RAM). Next, an attack signal B is applied to another envelope circuit 18 to generate timing for attack and decay of the envelope waveshape by the signals C1 and C2 as in the case of the envelope control circuit 17. A channel specify signal (CH16) from the channel decoder 21 is provided to the envelope control circuit 18, from which a specified address signal is applied via the OR circuit 15 to the envelope coefficient memory 13. In this case, when the attack end signal C1 is generated from the accumulator 11, a control signal from the envelope control circuit 18 becomes high-level, by which the coefficient gate 26 is altered to the OFF state, cutting off the coefficient from the envelope coefficient memory 13 to the accumulator 11. As a result of this, the accumulator 11 adds "0", and hence it continues to hold and output the same value. In other words, the operations of the envelope control circuits 17 and 18 differ in the ON-OFF state of the coefficient gate 26 at the time of generation of the attack end signal C1 from the accumulator 11, by which an envelope with no hold state or an envelope with a hold state is selected. In this circuit these two kinds of waveshapes are contained in a specified channel.

The accumulator 11 accumulates the summing coefficients specified by the addresses from the address counter 20 and channel specify signals fed from the envelope control circuits 17 and 18 via an OR circuit 16 and yields eight-bit binary address information as an accumulated output signal, which is provided to an envelope waveshape table 14. The data to be processed by the accumulator 11 is 10-bit and includes carry signals C1 and C2 in addition to the abovesaid eight-bit address data. In the case where the eight-bit address data is provided to the envelope waveshape table 14, only five high-order bits are used for an address, discarding the remaining three low-order bits. The signal C1 indicates the end of the attack period and the signal C2 indicates the end of decay. The both signals are applied to the envelope control circuit 17. The accumulator 11 provides an accumulated output signal of 16 envelope waves corresponding to 16 channels.

Next, the content of the envelope waveshape table 14 is applied to an exclusive OR circuit 22. When the signal C1 assumes a higher level than does the initial value of the next cycle after completion of 32 words of an attack waveshape by the signal C1, the data from the envelope waveshape table 14 is inverted to form a decay waveshape. The output from the exclusive OR circuit 22 is converted by a D-A converter 23 to analog form, obtaining an envelope waveshape.

A tone source unit is similar in construction to the envelope unit. In synchronism with a channel address from the address counter 20, a tone source summing coefficient is read out from a tone coefficient memory 30 and applied to a tone accumulator 31 composed of an adder, a gate circuit, a register and a memory (RAM). In the tone accumulator 31 tone coefficients are accumulated to provide an accumulated output signal corresponding to a tone source frequency, which is applied as an address to a 256-word sine wave table 32 to output therefrom a sine wave of half-wavelength. This output is provided to an exclusive OR circuit 33 as in the case of the envelope and inverted by a carry signal C1′ of the accumulated output signal from the tone accumulator 31 to obtain a digital sine-wave tone source waveshape. The frequency of this tone source waveshape is applied to a multiplying type D-A converter 34, wherein it is converted into an analog signal multiplied by the envelope waveshape available from the D-A converter 23 which forms a part of the aforementioned envelope unit. And the analog data time-divided by an analog multiplexer 35 of the next stage is distributed to the channels CH1 to CH16 and analog data of 1/16 unit time is held by a sample hold circuit 36, thereafter being outputted.

One method that the present inventor has proposed for simplifying the arrangement described above is to accumulate the frequency information and the envelope information by use of a common accumulator on a time-divided basis, as shown in an embodiment described later. Further, although in the prior structure the envelope coefficient memory stores the attack and decay coefficients at different addresses, the present inventor has proposed to switch the coefficients outside of the envelope coefficient memory to reduce its capacity by half, taking notice of the fact that both the coefficients can be loaded at the same address.

In the loop of the envelope accumulator, the data of the period $T_2$ is applied from the envelope coefficient memory 13 to the full adder 51 via the AND gate 42 and the OR gate 43. At the same time, previous data in the envelope memory 56 is read out therefrom into the full adder 51 for addition to the data from the envelope coefficient memory 13. The added output from the full adder 51 is provided to the AND gate 54, wherein it is gated by a control signal from the envelope control circuit referred to previously with regard to FIG. 1 and the output from the AND gate 54 is latched by the envelope register 55. Its content is stored in the envelope memory 56 and, at the same time, it is sent to the envelope waveshape table 14 to read out therefrom an envelope waveshape, which is fed to the D-A converter 23 following the procedure described previously in connection with FIG. 1.

Figure 5:
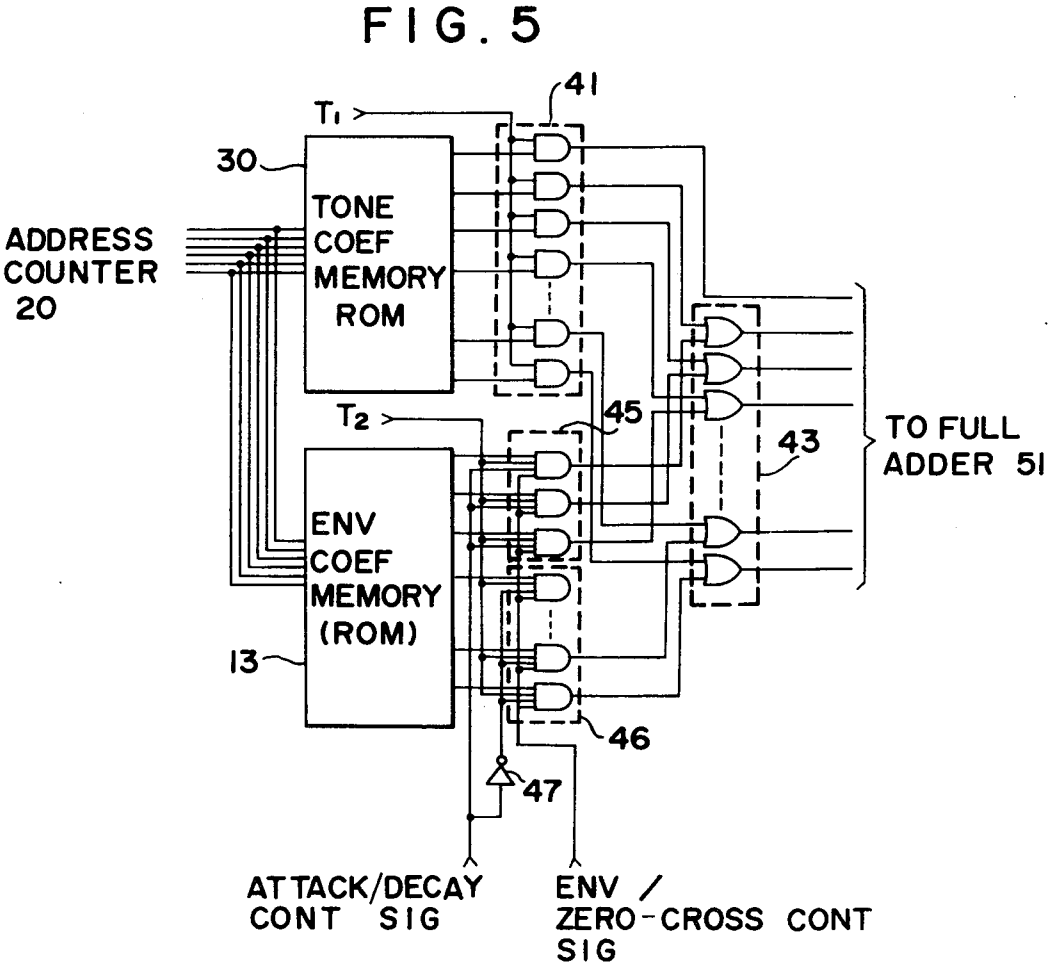
FIG. 5 shows in detail the principal part of the embodiment depicted in FIG. 4.

FIG. 5 illustrates in detail an example of the circuit arrangment of the principal part of the embodiment depicted in FIG. 4.

In FIG. 5, the tone coefficient memory 30 and the envelope coefficient memory 13 are accessed in parallel by, for example, six-bit address signals from the address counter 20. For example, 10-bit frequency data thus read out from the tone coefficient memory 30 is synchronized by the AND gate 41 with the period $T_1$ and applied via the OR gate 43 to the full adder 51.

In the envelope coefficient memory 13, the attack coefficient is stored by three high-order bits of one word read out by one address and the decay coefficient is stored by the remaining six low-order bits. The envelope waveshape is usually sharp in attack but dull in decay. Accordingly, attack coefficients of most rhythms are concentrated on the high-order bits and their decay coefficients are concentrated on the low-order bits. By utilizing such a characteristic, it is possible to store the attack coefficient and the decay coefficient by the high-order bits and the low-order bits of the same address. The following table shows, by way of example bits for the attack and decay of various rhythms.

| | | Word | | | | | |
|---|---|---|---|---|---|---|---|
| | Bit | Bass drum 1 | Snare 2 | Claves 3 | Rim shot 4 | Low conga 5 | Guiro 6 |
| | MSB | | | | | | |
| Attack | 1 | 1 | 1 | 1 | 1 | 1 | 0 |
| | 2 | 0 | 0 | 0 | 0 | 0 | 0 |
| | 3 | 0 | 0 | 0 | 0 | 0 | 1 |
| Decay | 4 | 1 | 0 | 0 | 1 | 0 | 0 |
| | 5 | 0 | 0 | 0 | 0 | 0 | 0 |
| | 6 | 1 | 1 | 0 | 1 | 0 | 0 |
| | 7 | 1 | 0 | 0 | 0 | 1 | 1 |
| | 8 | 0 | 1 | 0 | 1 | 0 | 0 |
| | LSB | | | | | | |
| | 9 | 1 | 0 | 1 | 1 | 1 | 1 |

Then, the three high-order bits corresponding to the attack are applied to the AND gate 45 and the six low-order bits corresponding to the decay are fed to the AND gate 46. The outputs from the AND gates 45 and 46 are both provided via the OR gate 43 to the full adder 51 in synchronism with the period $T_2$. In the period $T_2$ the attack/decay control line is connected directly to the AND gate 45 and connected via the inverter 46 to the AND gate 46, conducting switching control between the attack and the decay. Further, as proposed in the inventor's prior Japanese Pat. Appln. No. 31410/79, and now Laid-Open Publication 55-124195, in order to reduce a distortion and noise resulting from multiplication of the tone and the envelope waveshape, an envelope/zero crossing control signal is applied to the AND gate 46 to provide synchronization between them.

Although the foregoing embodiments are shown to employ an accumulator in common to the tone and the envelope, the present invention is also applicable to the case of using different accumulators for the tone and the envelope.

As has been described in the foregoing, according to the present invention, the attack and the decay coefficient are respectively stored by the high-order and the low-order bits of a word of the same address of the envelope coefficient memory for loading envelope information and they are switched on the outside of the envelope coefficient memory. This permits reduction of the required memory capacity by half, and hence leads to effective miniaturization of the device without exerting any influence on the envelope waveshape generating function. Moreover, the frequency information loaded in the tone coefficient memory and the envelope information loaded in the envelope coefficient memory are accumulated by a common accumulator on the time-divided basis. But this provides the same function as that obtainable in the case of employing different accumulators for the frequency information and the envelope information and, in addition, this permits simplification and miniaturization of the arrangement.

It will be apparant that many modifications and variations may be effected without departing from the scope of the novel concepts of this invention.

What is claimed is:

1. A rhythm generator comprising:

a musical sound generating circuit for reading out a musical sound from a musical waveshape memory using address information obtained by accumulating frequency information stored in a tone coefficient memory;

an envelope generating circuit for reading out from an envelope memory an envelope waveshape corresponding to each tone by accumulating envelope information determining an envelope time corresponding to each tone using address information obtained by accumulating the envelope information stored in an envelope coefficient memory; and an address counter for performing address assignment to cause the musical sound generating circuit and the envelope generating circuit to operate on a time-divided basis;

wherein the frequency information and the envelope information are respectively accumulated by a common accumulator on the time-divided basis.

2. A rhythm generator comprising:

a musical sound generating circuit for reading out a musical sound from a musical waveshape memory using address information obtained by accumulating frequency information stored in a tone coefficient memory;

an envelope generating circuit for reading out from an envelope memory an envelope waveshape corresponding to each tone by accumulating envelope information determining an envelope time corresponding to each tone using address information obtained by accumulating the envelope information stored in an envelope coefficient memory;

an address counter for performing address assignment to cause the musical sound generating circuit and the envelope generating circuit to operate on a time-divided basis; and means for storing attack and decay coefficients in the envelope coefficient memory by high-order and low-order bits of the same address, respectively, and for selectively reading out the contents of the high-order and the low-order bits.

* * * * *